US005206692A

United States Patent [19]

Ishida et al.

[11] Patent Number: 5,206,692

[45] Date of Patent: Apr. 27, 1993

[54] IMAGE FORMING APPARATUS HAVING AN INTEGRAL TONER SUPPLY CONTAINER AND TONER STORAGE CONTAINER

[75] Inventors: Takao Ishida, Yokohama; Naoto Higure, Kawasaki, both of Japan

[73] Assignee: Kabushiki Kaisha Toshiba, Kawasaki, Japan

[21] Appl. No.: 791,517

[22] Filed: Nov. 14, 1991

[30] Foreign Application Priority Data

Nov. 30, 1990 [JP] Japan ..... 2-340532

[51] Int. Cl.[5] ..... G03G 15/00

[52] U.S. Cl. ..... 355/260; 355/245; 355/298

[58] Field of Search ..... 355/245, 260, 298

[56] References Cited

U.S. PATENT DOCUMENTS

| | | | |
|---|---|---|---|
| 4,899,690 | 2/1990 | Hacknauer et al. | 355/260 X |
| 5,017,962 | 5/1991 | Tsuji et al. | 355/245 X |
| 5,121,168 | 6/1992 | Aoki et al. | 355/298 |
| 5,126,799 | 6/1992 | Matsuura et al. | 355/298 |

*Primary Examiner*—Joan H. Pendegrass
*Attorney, Agent, or Firm*—Foley & Lardner

[57] ABSTRACT

There is provided a kit having integrally a supply toner storage section for supplying a developer to a developing unit, and a waste toner storing section for storing the developer removed from a photosensitive body by a non-transferred toner removing means. The kit is detachable from the developing unit and the non-transferred toner removing means. The condition of (B)>(C)>(B)×(A) is satisfied, where (A)=the non-transfer rate by a transfer charger, (B)=the developer storage amount of the supply toner storage section, and (C)=the developer storage amount of the waste toner storage section.

9 Claims, 8 Drawing Sheets

IMAGE FORMING APPARATUS HAVING AN INTEGRAL TONER SUPPLY CONTAINER AND TONER STORAGE CONTAINER

BACKGROUND OF THE INVENTION

1. Field of the Invention

The present invention relates to an image forming apparatus for forming an image in an electronic photographing process using a laser printer, etc.

2. Description of the Related Art

In most image forming apparatuses, an image is transferred onto a paper sheet by passing the sheet through an image transfer unit of an electronic photographic process unit in which such steps as charging, exposure, development, transfer, peeling, cleaning, etc. are carried out.

The paper sheet bearing the image is passed between a pair of fixing rollers, so that the image is fixed.

This type of conventional image forming apparatus (e.g. laser printer) employs a disposable cartridge type developer ("toner") supply device for supplying toner to a developing unit built in the apparatus body.

The toner supply cartridge ("supply container") is mounted exchangeably in the developing unit in the apparatus body.

Non-transferred toner, which has not been transferred on the paper sheet in the image transfer unit, is removed from a photosensitive body by a cleaning device. The removed toner is brought to the outside of the process unit and is recovered in the disposable cartridge type container. The toner recovering cartridge ("recovery container"), too, is mounted exchangeably in the process unit built in the apparatus body.

The "empty" state of the supply cartridge and the "full" state of the recovery cartridge are detected by a detector, and the operator exchanges the cartridges, when necessary, on the basis of the detection result.

In the prior art, the toner supply cartridge and the toner recovery cartridge are separated, or, in order to simplify the exchange process, the toner supply cartridge and the toner recovery cartridge are integrated, respectively, with the developing means, cleaning means, photosensitive drum, etc.

However, if the toner supply cartridge and the toner recovery cartridge are separated, the cartridges must be exchanged each time the toner is supplied or non-used toner is dumped. This is troublesome.

On the other hand, when the toner supply cartridge and the toner recovery cartridge ar integrated with the developing means, cleaning means or photosensitive drum, the exchange process is simplified; however, the storage amounts of supply toner and non-used toner are limited owing to the practical size of the integrated cartridge unit. Consequently, the exchange cycle of the entire unit is shortened, and the unit must be exchanged earlier than the end of lifetime of the relatively expensive developing means, cleaning means and photosensitive drum. Thus, the running cost of the apparatus increases.

SUMMARY OF THE INVENTION

The object of the present invention is to provide an image forming apparatus wherein a supply container and a storage container are integrated, and the integrated device is detachable from cleaning means and developing means, whereby the frequency of maintenance by a user can be reduced and the running cost can also be reduced.

According to this invention, there is provided an image forming apparatus comprising: means for developing a latent image formed on an image carrying body with a developing agent; mean for transferring the image developed by the developing means to a recording medium; means for removing the developing agent remaining on the image carrying body after transfer of the developed image by the transferring means; means for storing the developing agent removed by the removing means; means for supplying the developing agent to the developing means, the supplying means having a storing portion for storing up to a predetermined amount of the developing agent; a first unit having the developing means; and a second unit detachably mountable to the first unit, the second unit having the storing means and the supplying means; wherein the condition of $B>d>A\times B$ is satisfied, where A represents a non-transfer rate of a transfer operation of the transferring means, B represents the developing agent capacity of the storing portion of the supplying means and C represents the developing agent capacity of the storing means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below explain the principles of the invention.

DETAILED DESCRIPTION OF THE PREFERRED EMBODIMENT

An embodiment of the present invention will now be described with reference to the accompanying drawings.

Figure 7:
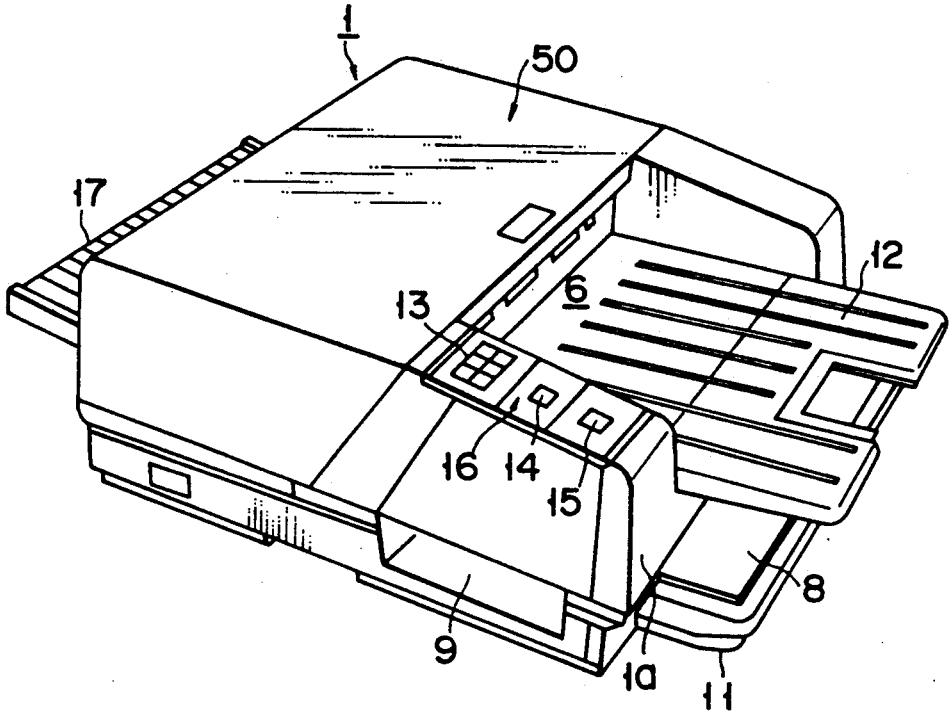
FIG. 7 shows the external appearance of a laser printer employed as an image-forming apparatus in which the developer supply device of the present invention is mounted.

FIG. 7 shows an external appearance of a laser printer functioning as an electronic photography type image forming apparatus using a semiconductor laser.

Figure 8:
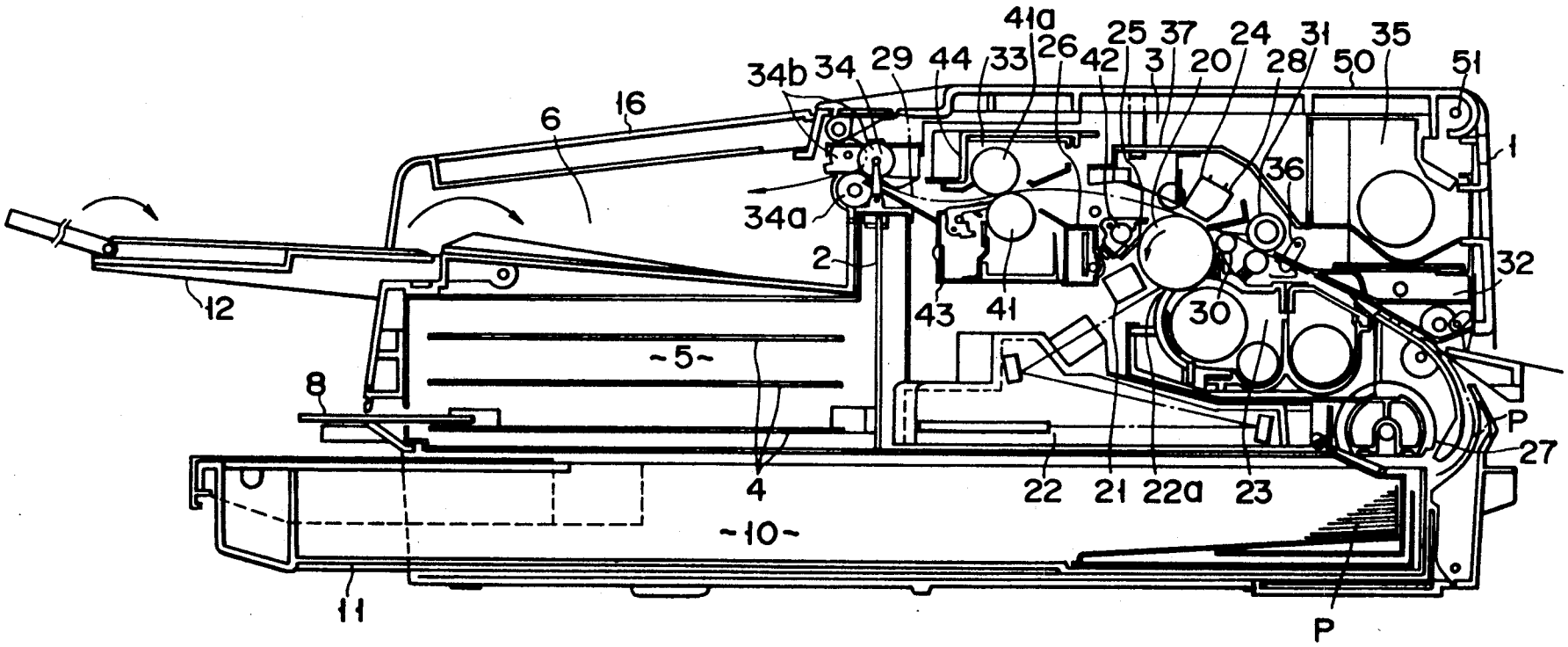
FIG. 8 schematically shows the internal structure of the laser printer.

FIG. 8 shows the internal structure of the laser printer.

The laser printer is connected to an external output device (or a host system, not shown) such as a computer or a word processor via a transmission controller such as an interface circuit. Upon receiving a print start signal from the host system, the laser printer starts an image recording operation and records the image on a paper sheet (a medium on which an image is to be transferred). Thus, the recorded image is output.

The structure of this laser printer will now be described.

As is shown in FIG. 7 and FIG. 8, reference numeral 1 denotes an apparatus body. A main control board 2 is provided at a center part of the inside of the body 1. An electronic photographing process unit 3 for forming an image is disposed in rear of the main control board 2 (on the right side in FIG. 7). A control board container 5 for containing a plurality of function-adding control boards 4 is provided in front of, and under, the process unit 3. A paper discharge unit 6 is provided in front of, and above, the control board container 5.

The number of function-adding control boards 4 capable of being mounted in the control board container 5 is three at a maximum. For example, the kinds of Chinese "Kanji" characters can be increased by employing the boards 4. A front edge portion of the lowermost function-adding control board 4 is provided with an IC card connector 7. A function-adding IC card 8 can be connected to the connector 7, thereby increasing the number of functions. A left end portion of the lowermost function-adding control board 4 is provided with two interfaces (not shown). The two interfaces are opposed to an opening 9 formed in the left side portion of the apparatus body 1. In FIG. 8, numeral 10 denotes a cassette container for receiving a paper cassette 11. The cassette container 10 is formed at a lower part in the apparatus body 1.

The paper discharge unit 6 is a recess formed in a front-side upper part of the apparatus body 1, as shown in FIG. 7. A front edge portion of the paper discharge unit 6 is provided with a paper tray 12. The paper tray 12 is rotatable in the direction of a solid-line arrow shown in FIG. 8. The size of the paper discharge unit 6 can be adjusted in accordance with the size of a discharged paper sheet P, by folding the tray 12.

A control panel 16 is provided on an upper surface of a left frame portion 1*a* of the body 1. The left frame portion la is situated on the left of the paper discharge unit 6. The control panel 16 has a display LED 13, a two-digit display segment 14 and a switch 15. A manual paper feed tray 17 is mounted on a rear end portion of the body 1.

The structure of the electronic photographing process unit 3, which carries out the electronic photographing processes, such as charging, exposure, development, transfer, peeling, cleaning and fixation, will now be described with reference to FIG. 8. Numeral 20 denotes a drum-shaped photosensitive body functioning as an image carrying body. The photosensitive body 20 is situated at an almost center area of a unit container in the body 1. On the lower side of the photosensitive body 20, are charging means 21, constituted by a scorotron, exposure portion 22*a* of a laser exposure unit 22, functioning as electrostatic latent image forming means, and a magnetic brush type developing unit 23 for a developing process.

On the upper side of the photosensitive body 20, there are provided transfer means 24, constituted by a scorotron, and non-transferred toner removing means 25, constituted by a rubber member. Numeral 26 denotes pre-exposure means.

Numeral 29 denotes a paper convey path formed in the apparatus body 1. Paper P fed from the paper cassette 11 via paper feeding means 27, or paper P fed from the manual feed tray 17 (FIG. 7) is guided along the paper convey path 29 through an image transfer unit 28 (formed between the photosensitive body 20 and transfer means 24) into the paper discharge unit 6 (provided on the upper side of the body 1). On the upstream side of the image transfer unit 28 in the paper convey path 29, there are provided a pair of convey rollers 30, a pair of aligning rollers 31 and a pair of convey rollers 32. A fixing unit 33 and a paper discharge roller unit 34 are provided on the downstream side of the image transfer unit 28 in the paper convey path 29.

Numeral 35 denotes a cooling fan unit situated on the upper side of the convey rollers 32. An aligning switch 36 is provided near the aligning rollers 31. A convey guide 37 is provided near the image transfer unit 28.

When a print start signal is supplied from the host system, the drum-shaped photosensitive body 20 rotates and the surface of the photosensitive body 20 is uniformly charged by the charging means 21. Then, a laser beam a, which has been modulated on the basis of dot image data supplied from the host system, is caused to scan the photosensitive body 20 by use of a laser exposure unit 22. Thus, an electrostatic latent image corresponding to the image signal is formed on the photosensitive body 20. The electrostatic image on the photosensitive body 20 is developed into a visible image by toner in a developing magnetic brush (not shown) within the developing unit 23.

On the other hand, in synchronism with the toner image forming operation, paper P picked up from the paper cassette 11 or inserted from the manual feed tray 17 is fed through the aligning rollers 31. The toner image formed on the photosensitive body 20 is transferred on the paper P by means of the transfer means 24. The paper P bearing the toner image is fed into the fixing unit 33 through the paper convey path 29, and the toner image is melted and fixed on the paper P. Then, the paper P is discharged into the discharge unit 6 via the paper discharge roller unit 34. The toner remaining on the photosensitive body 20 after the toner image was transferred on the paper P is removed by a cleaning blade 25 formed of urethane rubber. The removed toner is conveyed to the outside of the process unit by means of a convey spiral 42.

The fixing unit 33 comprises a heat roller 41 including a heater lamp, and a pressing roller 41*a* pressed on the heat roller 41. The paper P is passed between the rollers 41 and 41*a* functioning as fixing rollers, so that the toner image is melted and fixed on the paper P. The heat roller 41 and pressing roller 41*a* are surrounded by a lower casing 43 and an upper casing 44, thereby forming such a structure that heat does not leak to the outside and a desirable temperature for fixation is maintained.

The paper discharge roller unit 34 comprises a lower roller 34*a* and an upper roller 34*b*. Along with a convey guide 37 and transfer means 24, the upper half of the paper discharge roller unit 34, which includes the upper roller 34*b*, is attached to the lower surface of a top cover 50 of the apparatus body 1. The top cover 50 is rotatable about a support shaft 51 provided at an upper rear portion of the body 1. The top cover 50 can be opened at to about 120° (maximum).

Figure 1:
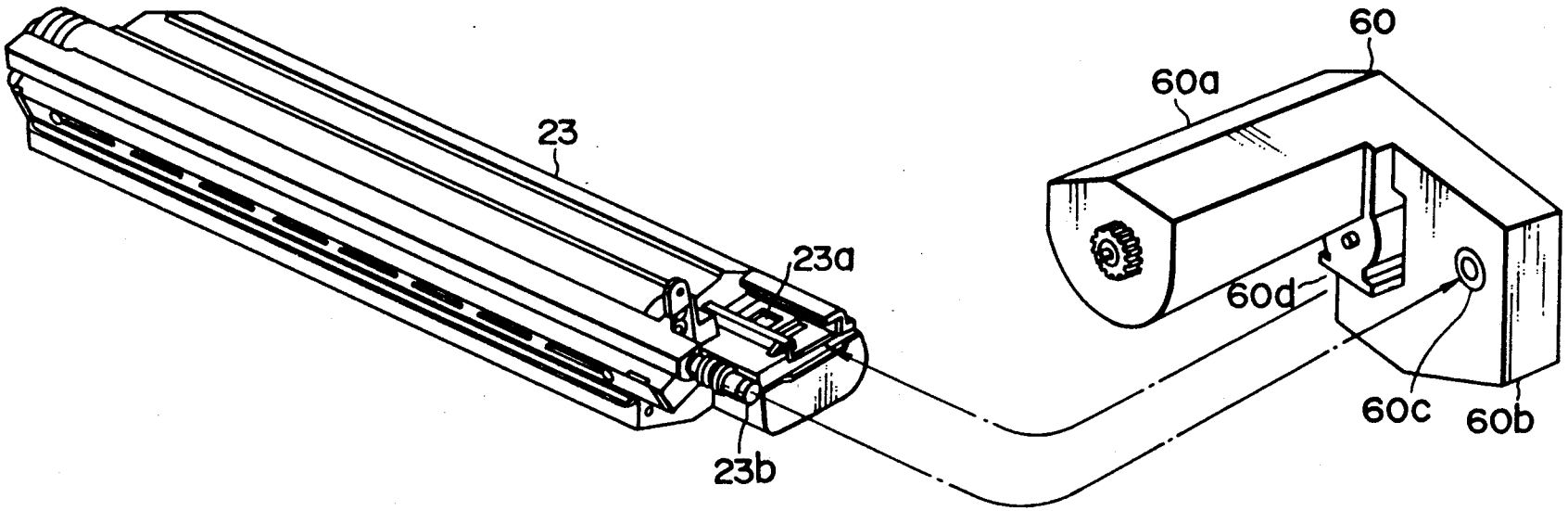
FIG. 1 is a perspective view showing an embodiment of the toner supply/recovery device according to the present invention.
Figure 2:
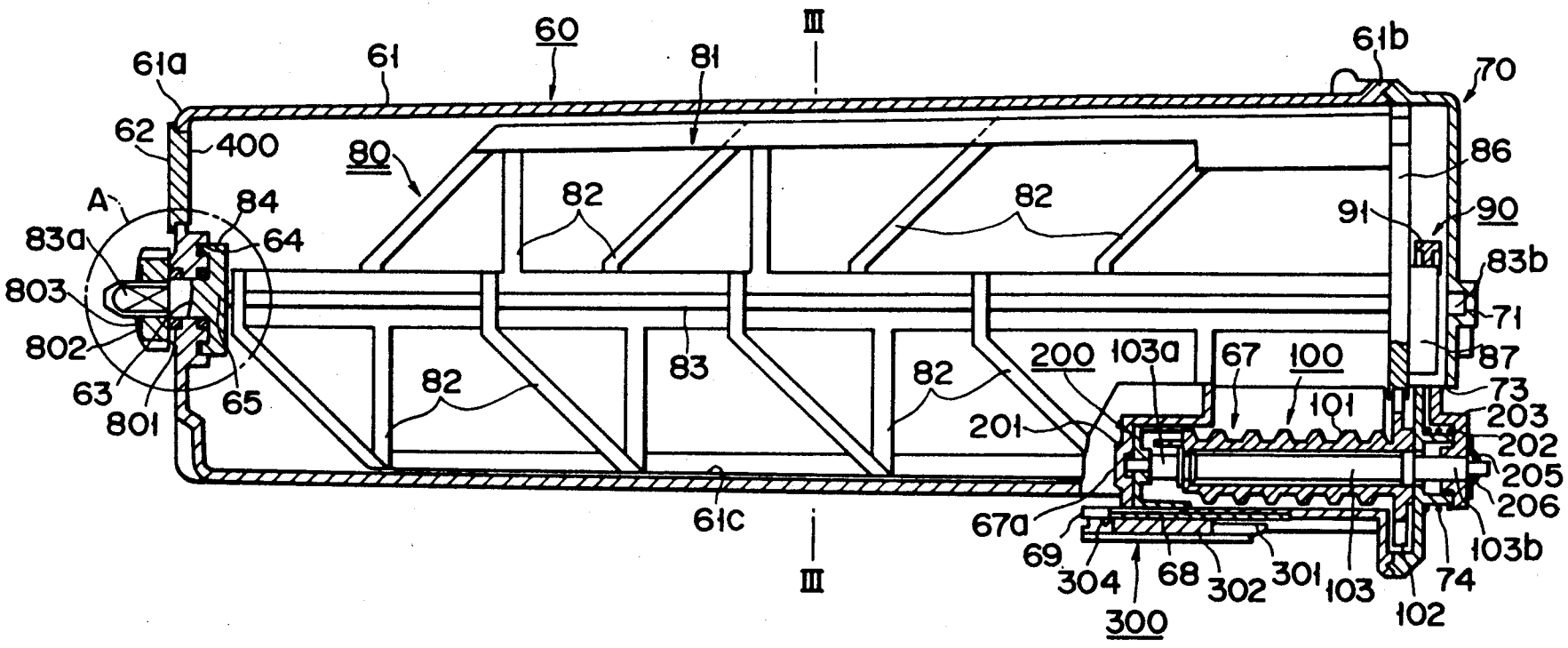
FIG. 2 is a vertical cross-sectional view of a toner supply unit of the toner supply/recovery device of FIG. 1.
Figure 9:
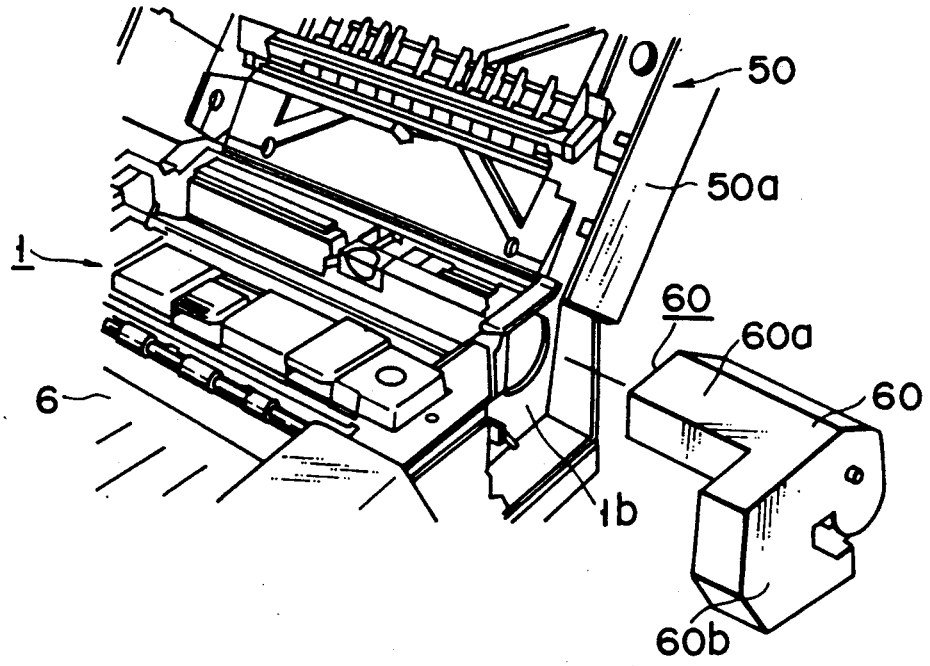
FIG. 9 shows the laser printer in the state wherein the top cover of the printer is opened.

When top cover 50 is opened,, the most of the paper convey path 29 and devices facing the path 29 are exposed, and paper P jammed in the path 29 can easily been removed. In addition, maintenance of the apparatus and exchange of parts is facilitated. An operating projection is provided on a right-hand inner surface 50*a* of the top cover 50. The operating projection opens and closes a rotary shutter of a cartridge type unit or kit 60 (described later) in accordance with the opening/closing operation of the top cover 50. Toner is supplied from the kit 60 to the developing unit 23. The kit 60 is removably inserted from the side of the right frame portion lb of the body 1, as shown in FIG. 9. As is shown in FIG. 1, the kit 60 is fitted in a toner supply hole 23*a* at the upper part of the developing unit 23, and toner is supplied into the hole 23*a*.

At the same time, a toner discharge hole 23*b* of the developing unit 23 is fitted in a waste toner receiving hole 60*c* of the kit 60.

The cartridge type kit 60 of this invention comprises a supply toner storage portion 60*a* functioning as cylindrical supply means for storing supply toner, and a box-shaped waste toner storage portion 60*b* functioning as storage means integrated with the supply toner storage portion 60*a*. The supply toner storage portion 60*a* and the waste toner storage portion 60*b* are completely partitioned; thus, supply toner and waste toner are not mixed.

The structure of the kit 60 will now be described in greater detail with reference to FIGS. 1 to 6.

The supply toner storage portion 60*a* comprises a hopper type elongated container 61 made of a synthetic resin such as ABS resin. Toner is contained in the container 61. At left end face 61*a* (in FIG. 2) of the container 61 along the longitudinal axis is closed and fitted in the apparatus body 1, and a right end face 61*b* is opened. The container 61 is tapered, slightly widened from the left end face 61*a* towards the right end face 61*b*.

The left end face (closed face) 61*a* the container 61 is provided with a toner filling port 62 and a shaft hole 63. A drive-side end portion 83*a* of a rotary shaft 83 of paddle frame 82 of toner stirring means 81 which constitutes toner supply means 80 (described later) is inserted into the shaft hole 63. Double annular grooves 64 and 65 are formed in the inner surface of the shaft hole 63.

The right opened end face 61*b* of the container 61 has a bearing portion 66. An end portion 92*a* of a rotary shaft 92 of a magnet swing lever 91, which is a structural element of waste toner stirring means 90 (described later), is inserted into the bearing portion 66. The opened end face 61*b* is tightly sealed by a cover 70 after the toner supply means 80 (described later) has been assembled. The inner surface of the cover 70 is provided with bearing portions 71 and 72. The bearing portion 71 supports the other end portion 83*b* of the rotary shaft 83 of the paddle frame of the toner stirring means 81, and the bearing portion 72 supports the other end portion 92*b* of the rotary shaft 92 of the magnet swing lever of the waste toner stirring means 90.

Reference numeral 67 denotes a toner supply unit formed at the right side of the bottom of the container 61. Toner convey means 100 which constitutes the toner supply means 80 is incorporated in the toner supply unit 67. A toner supply port 68 is formed in the left part of the bottom of the toner supply unit 67. Fallen toner is supplied into the developing unit 23 though the toner supply port 68. First shutter means 200 and second shutter means 300 (described later) are situated so as to correspond to the toner supply port 68.

Figure 3:
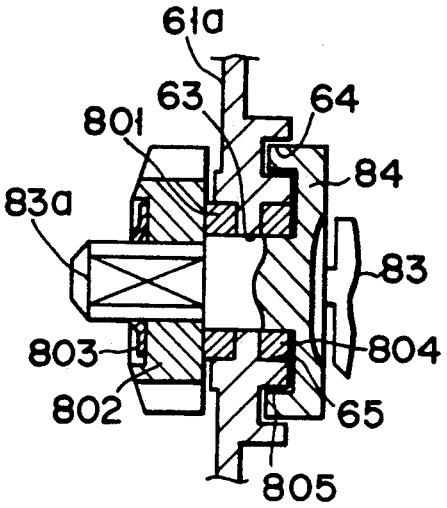
FIG. 3 is an enlarged cross-sectional view showing the assembled state of toner stirring means shown in FIG. 2 in a dot-and-dash line circle A.
Figure 4:
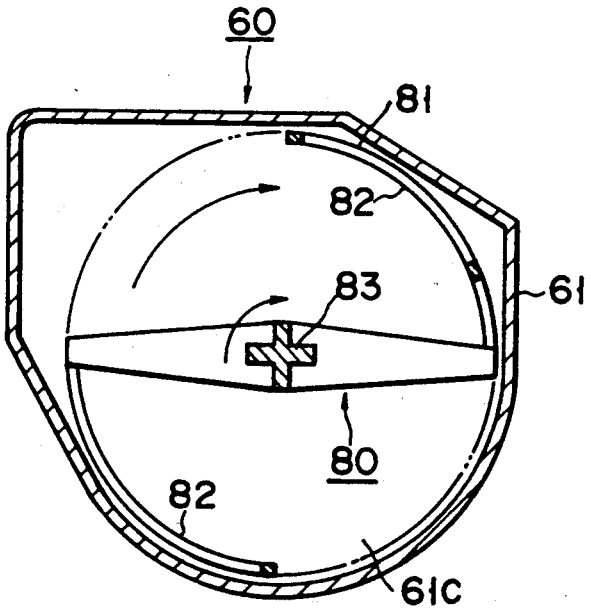
FIG. 4 is a cross-sectional view taken along line III—III in FIG. 2.
Figure 5:
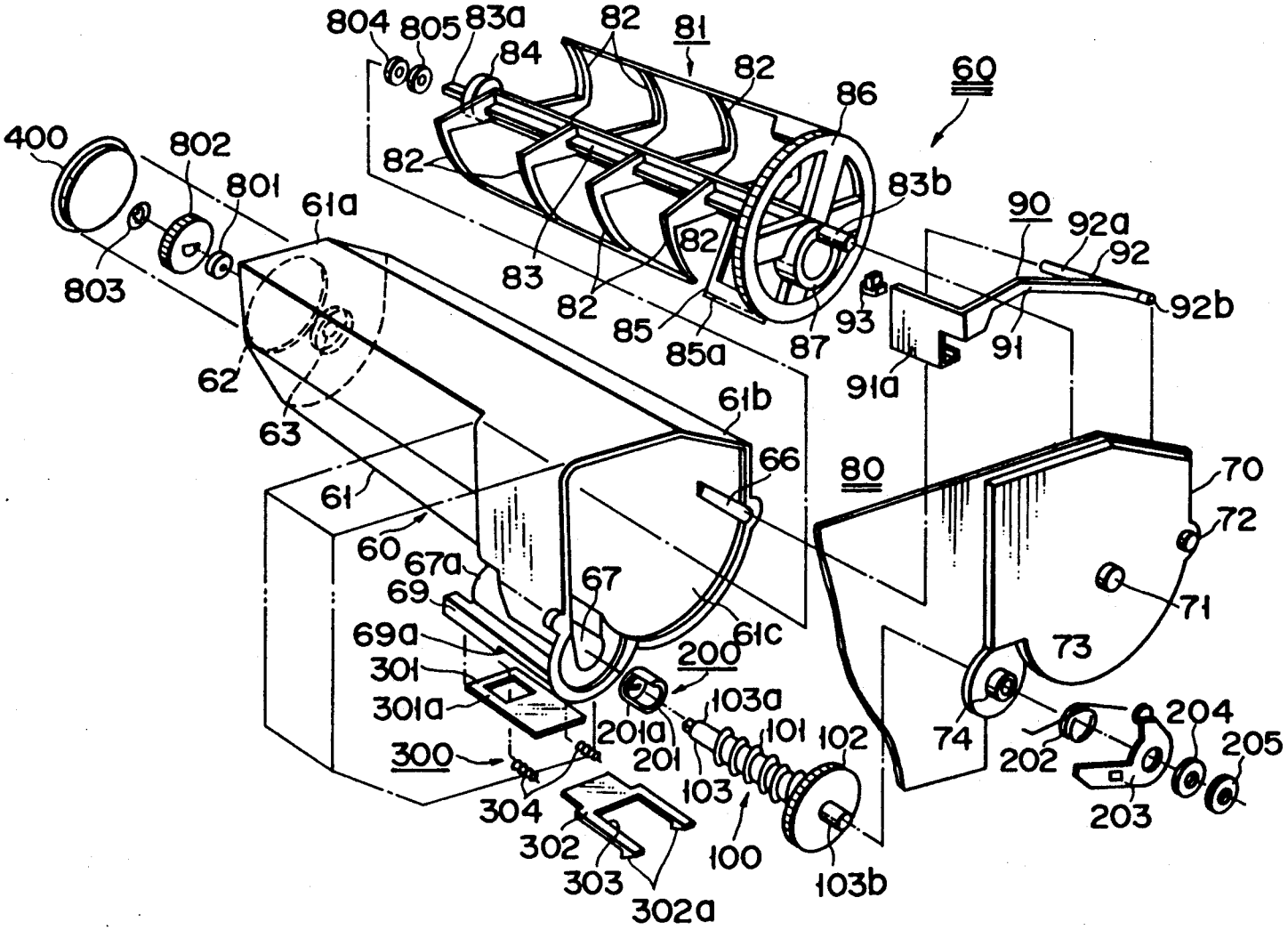
FIG. 5 is an exploded perspective view illustrating the assembly of the toner stirring means.

As is shown in FIGS. 3 to 5, the toner stirring means 81 which constitutes the toner supply means 80 is a reel-shaped ABS resin frame having a diameter of, e.g. 60 mm. The toner stirring means 81 is constituted by integrating paddle frames 82 helically about the rotary shaft 83 having a cruciform cross section. The drive-side end portion 83*a* of the rotary shaft 83 is inserted in the shaft hole 63 formed in the closed end face 61*a* of the container 61, and the othér end portion 83*b* is inserted in the bearing portion 71 of the cover 70 which seals the open end face 61*b* of the container 61. As is shown in FIG. 3 the drive-side end portion 83*a* projecting from the closed end face 61*a* of the container 61 is coupled via a first pad 801 to a drive gear 802 capable of being meshed with another drive gear (not shown) on the apparatus body (1) side. The drive gear 802 is fixed by means of a spring washer 803. In addition, the drive-side end portion 83*a* of the rotary shaft 83 is integrated with an annular flange 84. The annular flange 84 is fitted in an outer annular groove 64 formed in on the inner side of the shaft groove 63 of the closed end face 61*a* of the container 61. A second pad 804 is fitted in an inner annular groove 65. A thin disc-like packing 805 is interposed between the second pad 804 and the inner surface of the annular flange 84, thereby constituting a shield structure. By virtue of a labyrinth effect, the sealing and lubricating properties of the peripheral portion of the shaft can be enhanced, and toner leakage, toner entrance to the peripheral portion of the shaft, generation of frictional heat and moisture entrance to the container 61 can be prevented. In operation, in the toner stirring means 81, toner (not shown) in the container 61 is "double" stirred by the spiral rotation of the paddle frames 82 and the rotation of the rotary shaft 83 having the cruciform cross section, and the toner is conveyed from the left side in the container 61 to the toner supply unit 67 situated on the right of the container 61.

In the figures, reference numeral 85 denotes a toner raking plate formed of an elastic thin material such as Mylar (tradename) or rubber. The toner raking plate 85 is provided at an end portion 82*a* of one of the paddle frames 82 (constituting the toner stirring means 81) which is associated with the toner supply unit 67. An end portion 85*a* of the toner raking plate 85 is brought into slidable contact with an inner bottom surface 61*c* of the container 61. The toner, which has been conveyed to the open end face (61*b*) side of the container 61 (i.e. one side along the longitudinal axis of the container 61) by the rotation of the toner stirring means 81, is raked and fed into the toner supply unit 67.

Numeral 86 denotes a large-diameter gear integrated with the other end portion 83*b* of the rotary shaft 83 included in the toner stirring means 81. Numeral 87 denotes an eccentric cam integrated with the outside portion of the gear 87. The large-diameter gear 86 is meshed with a small-diameter gear 102 integrated with a spiral shaft 101 which is constituent element of the toner convey means 100, thereby rotating the spiral shaft 101. The aforementioned magnet swing lever (empty lever) 91 included in the waste toner stirring means 90 is engaged with the eccentric cam 87. The empty lever 91 is vertically swung in accordance with the rotation of the large-diameter gear 86 or rotary shaft 83 of the toner stirring means 81.

Figure 6:
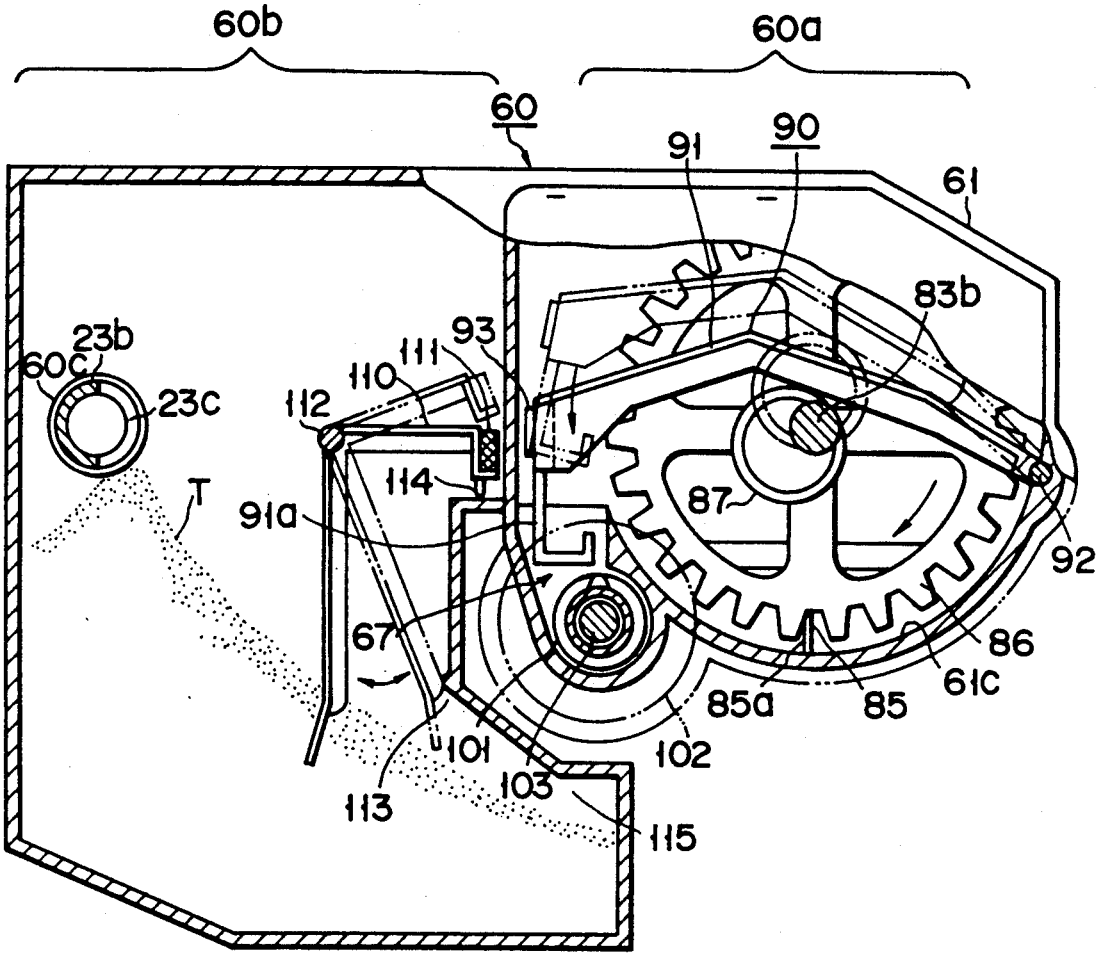
FIG. 6 shows the waste toner stirring means.

The magnet swing lever 91 of the waste toner stirring means 90 is bent, as shown in FIGS. 5 and 6. One end portion 92*a* of rotary shaft 92 of lever 91 is inserted in the bearing 66 provided on the right open end face 61*b* of the container 61. The other end portion 92*b* of the rotary shaft 92 is supported in the bearing 72 formed on the inner surface of the cover 70. A center portion of the lever 91 is engaged with the eccentric cam 87 integrated with the other end portion 83*b* of the rotary shaft 83 of the toner stirring means 81. A swing end portion 91*a* of the magnet swing lever 91 is provided with a permanent magnet 93 and is swung in accordance with the rotation of the eccentric cam 87 of the lever 91, as shown in FIG. 6. Thus, the permanent magnet 93 is moved substantially vertically. Recovery toner T sent to the waste toner container 60*b* is stirred by the vertical movement of the permanent magnet 93.

The recovery toner stirring mechanism in the waste toner container 60*b* will now be described. As is shown in FIG. 6, a waste toner stirring lever 110 has an L-shape. Both end portions of a rotary shaft 112 of the lever 110 are inserted in and supported by bearings (not shown) formed on the inner surfaces of the container 61 and cover 70. A right end of the lever 110 is provided with a magnetic body (iron) 111. A lower end portion of the waste toner stirring lever 110 is formed like a knife, so that toner can easily be stirred. Normally, the lever 110 is urged to rotate clockwise owing to the weight of the magnetic body 111 attached to the right end of the lever 110. However, a projection 114 attached below the magnetic body 111 abuts on a part of surface of the container 61, and the lever 110 remains static. If the permanent magnet 93 moves upwards in this state, the magnetic body 111 is lifted by the magnet 110 situated near the magnetic body 111 with a wall interposed. Accordingly, the waste toner stirring lever 110 rotates counterclockwise, and the lower end portion of the lever 110 abuts on a projection 113 provided on the container 61 so that the lever 110 is stopped. The permanent magnet 93, however, further moves upwards, and the distance between the magnet 93 and the magnetic body 111 increases. At last, the attraction force of the permanent magnet 93 exerted on the magnetic body 111 is overcome by the weight of the magnetic body 111, and the lever 110 rotates clockwise and returns to the original position. By this swing motion of the waste toner stirring lever 110, the knife-shaped lower end portion of the lever 110 flattens the recovered toner T.

As has been described above, the combination of the toner supply function and the toner recovery function can bring about the following advantages. Conventionally, the toner supply function and the toner recovery function are designated to separate containers, and the apparatus body 1 is provided with two detection switches for detecting the presence/absence of toner in these containers. That is, it is necessary to provide two detection switches. By contrast, if the toner supply function and toner recovery function are integrated, it is sufficient to provide only one detection switch, and the cost of the apparatus body 1 can be reduced.

Furthermore, a detection switch for detecting the "full" state of the toner container 60*b* can be dispensed with. Conventionally, the apparatus body 1 has a detection mechanism for detecting whether the toner container 60*b* is full. When the "full" state of the container is detected, the apparatus body tells this state to the operator by means of sound or display, and the operator replaces the toner container 60*b* with a new one. In the present embodiment, however, the apparatus body 1 detects only the presence/absence of toner in the toner supply container 60*a*, and when the supply toner is "empty", the operator replaces the kit 60 with a new one. In other words, the state in the toner container 60*b* is not detected. As a matter of course, even when the toner container 60*b* is filled with recovery toner, the apparatus body 1 continues the printing operation. Thus, in the present embodiment, the ratio of the capacity of the supply toner container 60*a* to that of the waste toner container 60*b* in the kit 60 (shown in FIG. 1) is determined as follows:

supply toner storage capacity > waste toner effective capacity > supply toner amount × non-transfer rate.

for the purpose of safety, it is desirable that the waste toner effective capacity be as large as possible. If this capacity is substantially equal to the supply toner storage capacity, the waste toner container 60*b* cannot become "full" in case of any trouble. However, the space of the apparatus body 1 is limited, and the waste toner effective capacity is naturally limited to a minimum necessary capacity. The minimum necessary capacity is represented by {supply toner amount × non-transfer rate}. More specifically, the capacity for the amount of toner that has not been transferred on paper P, after all toner in the supply toner container 60*a* has been consumed, must be provided as a minimum necessary capacity. Normally, the transfer efficiency is 75% to 90%, and 10% to 25% of supplied toner is recovered as non-transferred toner. Therefore, 25% of the supplied toner must be stored in the waste toner container 60*b*. In fact, however, the effective capacity of the waste toner container 60*b* is considered to be 30% of the supply toner capacity, taking into account the troubles of charging, transfer, bias, etc. Thus, in the present embodiment, the supply toner capacity is 500 cc, whereas the waste toner effective capacity is 150 cc.

Accordingly, even if the function of detecting the waste toner "full" state in the apparatus body 1 is omitted, the printing operation can e continued with no problem, and the cost of the apparatus body can be reduced. In addition, the operation is free from the troublesome procedure of exchanging the waste toner container 60*b*.

The present invention is not limited to the above embodiment, and various changes and modifications can be made without departing from the spirit of the present invention.

As has been described above, according to the present invention, the toner supply means and the waste toner container means are integrated into one unit. Thus, the supply means and container means can be exchanged by a single process and the operability of the apparatus can be enhanced.

Furthermore, the unit is detachable from the cleaning means and developing means; therefore, the unit can be exchanged singly, there is no need to exchange the cleaning means and developing means unnecessarily, and the running cost can be reduced.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An image forming apparatus comprising:

developing means for developing with a developing agent a latent image formed on an image carrying body;

transferring means for transferring the image developed by the developing means to a recorded medium;

removing means for removing the developing agent remaining on the image carrying body after transfer of the developed image by the transferring means;

convey means for conveying the developing agent removed by the removing means;

supply means having a first storage portion with a predetermined capacity for storing the developing agent, said supply means supplying the developing agent from the first storage portion to the developing means;

storing means having a second storage portion, the capacity of which is less than that of the first storage portion of the supply means and is greater than the value of the product of a non-transfer rate of the transfer means and the capacity of the first storage portion of the supply means, said second storage portion storing the developing agent removed from the image carrying body by the removing means and conveyed by the convey means;

a first unit having the developing means and the convey means; and a second unit detachably mountable to the first unit, the second unit having the storing means and the supply means.

2. The apparatus according to claim 1 wherein the first unit has positioning means for positioning the second unit at one end portion side of the developing means.

3. The apparatus according to claim 1, wherein the second unit has an isolating portion for isolating the developer supplying means and the storing means.

4. The apparatus according to claim 1, wherein the storing means includes a first storing portion for receiving the developing agent removed from the image carrying body, and a second storing portion for storing the developer provided at a position different from the position of the first storing portion.

5. The apparatus according to claim 1, wherein the non-transfer rate of the developing agent of the transfer means is 10 to 25%, and the capacity of the second storage portion of the storing means is more than 30% of the capacity of the first storing portion of the supply means.

6. The apparatus according to claim 1, wherein the capacity of the first storing portion of the supply means is about 500 cc, and the capacity of the second storing portion of the storing means is about 150 cc.

7. The apparatus according to claim 1, wherein a stirring/conveying mechanism for stirring/conveying the developing agent is provided within the first storing portion of the supply means.

8. The apparatus according to claim 7, wherein a stirring mechanism for stirring the developing agent is provided within the second storing portion of the storing means.

9. The apparatus according to claim 8, wherein said stirring mechanism of the storing means is actuated by a magnetic force in accordance with operation of the stirring/conveying mechanism of the supply means.

* * * * *